United States Patent [19]

Yoshida

[11] Patent Number: 4,673,911

[45] Date of Patent: Jun. 16, 1987

[54] ELEVATOR REMOTE-CONTROL APPARATUS

[75] Inventor: Kenji Yoshida, Gifu City, Japan

[73] Assignee: Mitsubishi Denki Kabushiki Kaisha, Tokyo, Japan

[21] Appl. No.: 810,184

[22] Filed: Dec. 18, 1985

[30] Foreign Application Priority Data

Dec. 25, 1984 [JP] Japan ..... 59-200307

[51] Int. Cl.[4] ..... B66B 1/06; B66B 3/00

[52] U.S. Cl. ..... 187/100; 455/603

[58] Field of Search ..... 340/19 R, 20, 21, 696, 340/539, 825–872; 455/603

[56] References Cited

FOREIGN PATENT DOCUMENTS 59-130868 3/1984 Japan .

*Primary Examiner*—Stewart J. Levy
*Assistant Examiner*—Joseph W. Roskos
*Attorney, Agent, or Firm*—Leydig, Voit & Mayer

[57] ABSTRACT

When a desired call has been registered with the up button or down button of a remote controller, an acceptance signal is delivered from an elevator control device, to turn 'on' the up button or down button of the hall button device. At the same time, a response signal corresponding to the acceptance signal is sent from the transmitter of the hall button device to the remote controller, and it is received by the receiver of the remote controller so as to turn 'on' the response lamp in correspondence with the call registration. Owing to such an arrangement, the ascent or descent call registration of an elevator can be reliably acknowledged on the remote controller side.

5 Claims, 3 Drawing Figures

ELEVATOR REMOTE-CONTROL APPARATUS

BACKGROUND OF THE INVENTION

This invention relates to an elevator remote-control apparatus with which the call registration operation of an elevator is performed at a position remote from the hall button device of the elevator.

In general, a factory, a warehouse or the like is equipped with a freight or luggage elevator in order to transport a transport vehicle, a truck, a motorcar etc. An elevator remote-control apparatus is used for controlling the elevator from the driver's cab of the transport vehicle or the like so as to carry out the transportation efficiently.

The outline of this remote-control apparatus will be explained with reference to FIG. 3.

In the figure, numeral 1 designates an elevator hall, numeral 2 a hall button device which is disposed on the wall of the elevator hall 1, and numeral 3 a receiver which receives a remote control signal from a remote controller. An up button 4 indicates the ascent direction of the cage of the elevator, and a response lamp 4*a* turns 'on' in response to the call registration of the up button 4. Likewise, a down button 5 indicates the descent direction of the cage, and a response lamp 5*a* turns 'on' in response to the call registration of the down button 5. Shown at numeral 6 is the remote controller. This remote controller 6 is provided with a transmitter 7 which transmits a remote control signal such as light, an electromagnetic wave, an ultrasonic wave or the like to the receiver 3 of the hall button device 2, an up button 8 which serves to register the ascent call of the elevator, and a down button 9 which serves to register the descent call of the elevator.

With the above construction, as the transport vehicle or the like comes near to the elevator hall 1, the driver thereof registers a desired elevator call by depressing the up button 8 or down button 9 of the remote controller 6 in the driver cab. Then, the remote control signal S corresponding to the ascent call or the descent call is transmitted from the transmitter 7. On the side of the hall button device 2, this remote control signal S is received by the receiver 3. Thereafter, though no illustration is made, a signal for registering the ascent call or descent call is delivered to an elevator control device through a signal processing circuit, and the response lamp 4*a* of the up button 4 or the response lamp 5*a* of the down button 5 is turned 'on' by an acceptance signal from the elevator.

With the elevator remote-control apparatus of the prior art constructed as described above, even when the operation of registering the desired call has been performed on the side of the remote controller 6, whether or not the desired call has been registered cannot be readily checked because the remote controller 6 is remote from the position of the response lamp 4*a* or 5*a* of the hall button device 2. This has led to the problem that visibility of the response lamps 4*a*, 4*b* may be hampered and, accordingly, the transportation efficiency decreased.

SUMMARY OF THE INVENTION

This invention has the objective of overcoming the problem as stated above, and has for its main object to provide an elevator remote-control apparatus with which the registration of an ascent or descent elevator call can be reliably acknowledged on the side of a remote controller, whereby a more efficient transportation system becomes possible.

An elevator remote-control apparatus according to this invention consists in that each of a remote controller and a hall button device is furnished with a transmitter and a receiver, and that response lamps are disposed also on the side of the remote controller.

When a desired call has been registered with the up button or down button of the remote controller, an acceptance signal is delivered from an elevator control device, to turn 'on' the up button or down button of the hall button device. At the same time, a response signal corresponding to the acceptance signal is sent from the transmitter of the hall button device to the remote controller, and it is received by the receiver of the remote controller so as to turn 'on' the response lamp in correspondence with the call registration.

BRIEF DESCRIPTION OF THE DRAWINGS

In the drawings, the same symbols indicate identical or corresponding portions.

DESCRIPTION OF THE PREFERRED EMBODIMENT

Figure 1:
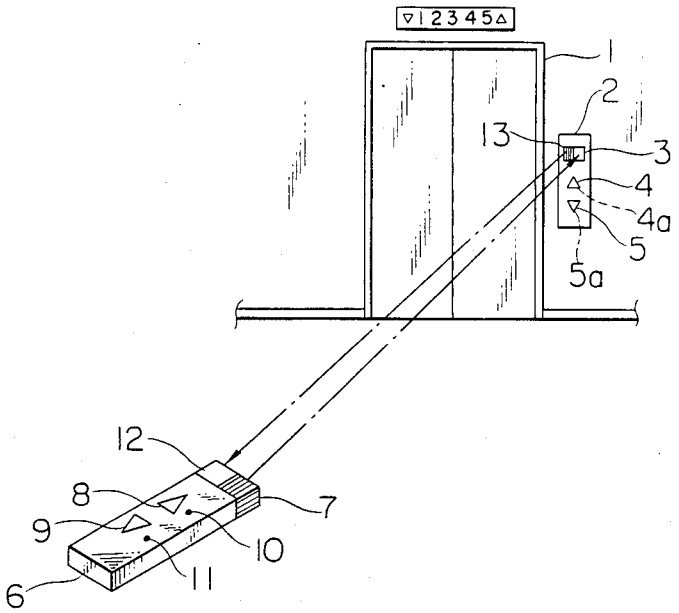
FIG. 1 is an exterior constructional view of an embodiment of an elevator remote-control apparatus according to this invention.
Figure 2:
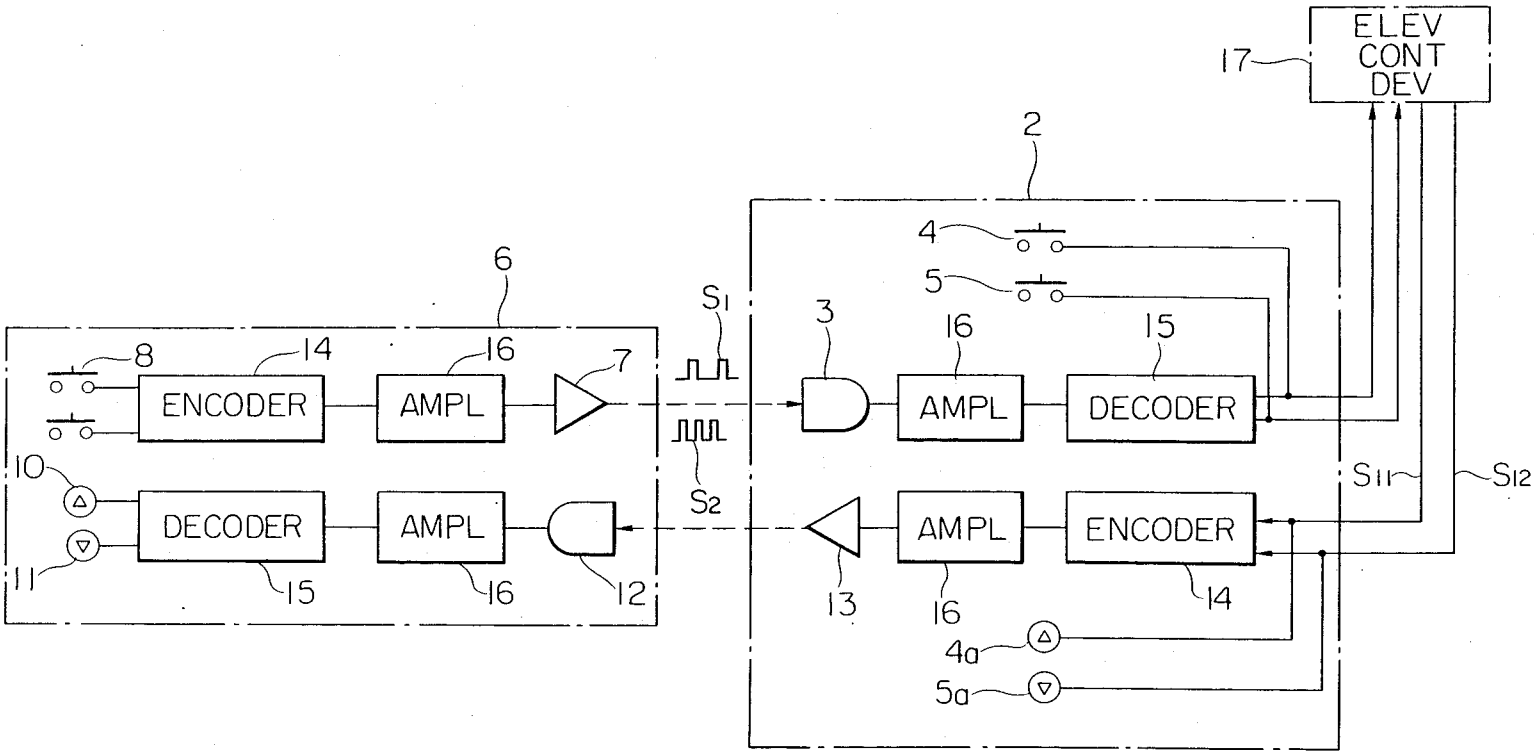
FIG. 2 is a block diagram showing a circuit arrangement in the elevator remote-control apparatus.

FIG. 1 is an exterior constructional view of one embodiment of an elevator remote-control apparatus according to this invention, while FIG. 2 is a block diagram showing the circuit arrangement of the elevator remote-control apparatus.

Figure 3:
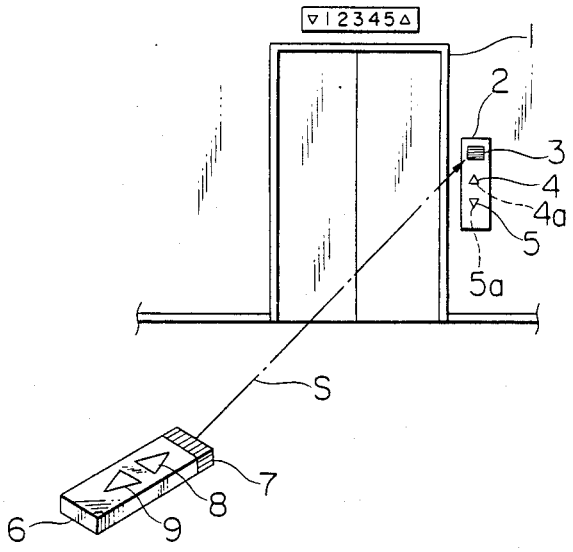
FIG. 3 PRIOR ART
FIG. 3 is an exterior constructional view of an elevator remote-control apparatus in a prior art.

In these figures, the same symbols are assigned to portions identical or equivalent to those in FIG. 3 showing the elevator remote-control apparatus of the prior art.

A response lamp 10 is disposed in correspondence with the up button 8 of the remote controller 6, while a response lamp 11 is disposed in correspondence with the down button 9 of the remote controller 6. A receiver 12 is disposed in the remote controller 6, and a transmitter 13 is disposed in the hall button device 2.

In FIG. 2, numeral 14 designates an encoder, numeral 15 a decoder, numeral 16 an amplifier, and numeral 17 an elevator control device.

With the above construction, when the up button 8 or down button 9 of the remote controller 6 is depressed in order to register a call into the elevator control device 17, the transmitter 7 is driven through the encoder 14 as well as the amplifier 16, to transmit an ascent call signal $S_1$ or descent call signal $S_2$ to the receiver 3 of the hall button device 2. The signal $S_1$ or $S_2$ received on the side of the receiver 3 is introduced into the elevator control device 17 through the amplifier 16 as well as the decoder 15, to register the elevator call. When the call registration has been done, an acceptance signal $S_{11}$ or $S_{12}$ is delivered from the elevator control device 17 to the hall button device 2, to turn 'on' the response lamp 4*a* or 5*a*, while the signal is led to the transmitter 13 through the encoder 14 as well as the amplifier 16. A signal corresponding to the acceptance signal $S_{11}$ or $S_{12}$ is transmitted from the transmitter 13 to the receiver 12 of the remote controller 6. This signal is led to the response lamp 10 or 11 through the amplifier 16 as well as the decoder 15, and turns it 'on'. Therefore, whether or not the desired call has been registered can be checked owing to the lighting display of the response lamp 10 or 11.

As described above, according to this invention, both a remote controller and a hall button device are furnished with transmitters and receivers, and the side of the remote controller is provided with response lamps which are respectively turned 'on' in response to acceptance signals that are sent from an elevator control device in correspondence with the registrations of an elevator for ascent and descent calls. Therefore, the presence or absence of the call registration can be readily known by acknowledging the lighting of the response lamp on the remote controller side, whereby a transportation system of higher efficiency utilizing the remote-controlled elevator becomes possible.

What is claimed is:

1. In an elevator remote-control apparatus wherein a call registration of an elevator is performed with a remote controller at a position remote from a hall button device of the elevator; an elevator remote-control apparatus comprising a transmitter which is disposed in said remote controller and which transmits a remote control signal for the call registration of the elevator, a receiver which is disposed in said hall button device and which receives the remote control signal transmitted from said transmitter and sends a signal for a predetermined call registration to an elevator control device, a transmitter which is disposed in said hall button device and which transmits a predetermined reponse signal to said remote controller on the basis of an acceptance signal that has been sent in accordance with the call registration by said elevator control device, a receiver which is disposed in said remote controller and which receives the response signal from said transmitter of said hall button device, and response lamps for displaying the call registrations, which are disposed in said remote controller and which are respectively turned 'on' in accordance with the corresponding response signals that have been received by said receiver of said remote controller.

2. An elevator remote-control apparatus according to claim 1, wherein said remote controller comprises manipulation buttons which serve to register an ascent hall call and a descent hall call of the elevator, respectively, and an encoder which, when the ascent and descent manipulation buttons have been depressed, produces different signals corresponding to the depressed manipulation buttons, and wherein said transmitter of said remote controller outputs the control signals in accordance with the produced signals of said encoder.

3. An elevator remote-control apparatus according to claim 2, wherein said receiver of said hall button device receives the signal transmitted from said transmitter of said remote controller and thereafter supplies the received content to a decoder, said decoder delivers the signal expressive of the ascent hall call or the descent hall call to said elevator control device for the call registration in accordance with the received content, and an output portion of said decoder is joined to connection leads between said elevator control device and hall buttons of said hall button device.

4. An elevator remote-control apparatus according to claim 1, wherein said hall button device comprises display means to receive the hall call registration signal sent from said elevator control device for the call registration and to display the registration, and an encoder which, upon receiving the registration signal, decides whether the registration is of an ascent hall call or a descent hall call and delivers a signal expressive of the content of the call to said transmitter of said hall button device, and wherein a portion of said encoder for receiving the registration signal is joined to connection leads between said elevator control device for the call registration and said display means.

5. An elevator remote-control apparatus according to claim 4, wherein said receiver of said remote controller comprises a decoder which decodes the content of the signal from said transmitter of said hall button device, and which outputs a signal for lighting up said response lamp corresponding to the content, in accordance with the decoded result.

* * * * *